US007287291B2

(12) United States Patent
Carlitz

(10) Patent No.: US 7,287,291 B2
(45) Date of Patent: Oct. 30, 2007

(54) MATTRESS WITH IMPROVED EDGE SUPPORT

(75) Inventor: Stuart Scott Carlitz, New Hope, NJ (US)

(73) Assignee: Mattress Development Company, Wilmington, DE (US)

( * ) Notice: Subject to any disclaimer, the term of this patent is extended or adjusted under 35 U.S.C. 154(b) by 0 days.

(21) Appl. No.: 11/337,406

(22) Filed: Jan. 23, 2006

(65) Prior Publication Data

US 2007/0169276 A1 Jul. 26, 2007

(51) Int. Cl.
*A47C 27/20* (2006.01)
*A47C 27/05* (2006.01)

(52) U.S. Cl. ..... 5/717; 5/739; 5/716; 5/260

(58) Field of Classification Search ..... 5/717, 5/739, 716, 260, 654.1, 655.7, 657.5; 267/91, 267/94, 96, 97
See application file for complete search history.

(56) References Cited

U.S. PATENT DOCUMENTS

| | | | | | |
|---|---|---|---|---|---|
| 1,933,816 | A * | 11/1933 | Meutsch | 5/652 |
| 2,029,076 | A * | 1/1936 | Leeman | 5/260 |
| 2,826,769 | A * | 3/1958 | Drews | 5/717 |
| 2,853,721 | A * | 9/1958 | Koenigsberg | 5/716 |
| 2,940,089 | A * | 6/1960 | Koenigsberg | 5/717 |
| 3,022,521 | A * | 2/1962 | Martin | 5/260 |
| 3,093,840 | A * | 6/1963 | Martin | 5/260 |
| 3,165,761 | A * | 1/1965 | Ross | 5/655.8 |
| RE25,742 | E * | 3/1965 | Martin | 5/260 |
| 3,242,505 | A * | 3/1966 | Tyhanic | 5/246 |
| 3,262,135 | A * | 7/1966 | Fasanella | 5/717 |
| 3,517,398 | A * | 6/1970 | Patton | 5/716 |
| 3,618,146 | A * | 11/1971 | Ferdinand | 5/717 |
| 3,790,972 | A * | 2/1974 | Lehmann | 5/721 |
| 3,822,426 | A * | 7/1974 | Mistarz | 5/717 |
| 3,840,915 | A * | 10/1974 | Simon | 5/261 |
| 3,981,033 | A * | 9/1976 | Toda | 5/717 |
| 5,027,459 | A * | 7/1991 | Perry et al. | 5/721 |
| 5,062,172 | A | 11/1991 | Stewart | |
| 5,210,890 | A * | 5/1993 | Hagglund | 5/239 |
| 5,499,414 | A | 3/1996 | Dillon | |
| 5,537,699 | A * | 7/1996 | Bonaddio et al. | 5/739 |
| 5,724,686 | A * | 3/1998 | Neal | 5/717 |
| 5,787,532 | A * | 8/1998 | Langer et al. | 5/717 |
| 5,924,150 | A | 7/1999 | Workman | |
| 5,927,696 | A | 7/1999 | Hagemeister | |
| 6,023,803 | A * | 2/2000 | Barman | 5/716 |
| 6,128,798 | A * | 10/2000 | Barman et al. | 5/716 |
| 6,263,533 | B1 * | 7/2001 | Dimitry et al. | 5/717 |
| 6,568,014 | B1 | 5/2003 | Sabalaskey et al. | |
| 6,944,899 | B2 * | 9/2005 | Gladney | 5/716 |
| 7,082,635 | B2 * | 8/2006 | Barman et al. | 5/717 |
| 2004/0158930 | A1 * | 8/2004 | Gladney | 5/716 |
| 2004/0237204 | A1 * | 12/2004 | Antinori | 5/716 |
| 2005/0005354 | A1 * | 1/2005 | Gladney et al. | 5/256 |
| 2006/0260062 | A1 * | 11/2006 | Barman et al. | 5/717 |
| 2007/0083996 | A1 * | 4/2007 | Wells | 5/717 |
| 2007/0118987 | A1 * | 5/2007 | Gladney et al. | 5/256 |

* cited by examiner

*Primary Examiner*—Robert G. Santos
(74) *Attorney, Agent, or Firm*—Dinsmore & Shohl LLP

(57) ABSTRACT

A mattress is provided comprising a plurality of inner coil springs and an edge support. The edge support comprises a foam border extending along the outer perimeter of the mattress and around the inner coil springs, a plurality of spaced slits inserted into the foam border, and a plurality of edge springs inserted into the plurality of spaced slits.

19 Claims, 6 Drawing Sheets

MATTRESS WITH IMPROVED EDGE SUPPORT

FIELD OF THE INVENTION

The present invention generally relates to mattresses and mattress components which provide improved edge support for the mattress.

BACKGROUND OF THE INVENTION

Typically, a mattress comprises a spring assembly covered by a cushioning pad and encased with an upholstery covering. The spring core is generally comprised of a matrix of coil springs laced together in the top and bottom planes of the springs and surrounded by top and bottom border wires. Additionally, the mattress may have border or edge support springs mounted between the top and bottom border wires to provide additional stiffness or support around the outer border of the mattress.

In normal use, the mattress and coil springs are subjected to increased local loading along the borders of the mattress, which tends to diminish not only the appearance of the mattress, but also the comfort it may provide. For example, sitting on the edge of the bed will depress the top border wire to the point, in time, where it may acquire a permanent deformation. Furthermore, this deformation may result in an uncomfortable tilting or sloping of the bed to one side resulting in a tendency for one lying on the mattress to roll to the low side of the bed.

Border reinforcing springs or edge support springs have been developed in various forms to support the edges of mattresses. However, problems can arise with these edge springs. For instance, the movement of the edge supports may result in undesirable noise. Furthermore, these edge supports do not always provide both firmness and comfort.

Mattresses comprising edge supports in accordance with the present invention, are advantageous in that they provide firmness, while maximizing comfort, and eliminate noise. Other features and advantages of the present invention will be apparent in light of the description of the invention embodied herein.

SUMMARY OF THE INVENTION

According to a first embodiment, a mattress is provided. The mattress comprises a plurality of inner coil springs. The mattress also comprises an edge support comprising a foam border extending along the outer perimeter of the mattress and around the inner coil springs, and further comprises a plurality of spaced slits inserted into the foam border, and a plurality of edge springs inserted into the plurality of spaced slits.

According to a second embodiment, a box spring is provided. The box spring comprises a plurality of inner coil springs. The box spring also comprises an edge support comprising a foam border extending along the outer perimeter of the box spring and around the inner coil springs, and further comprises a plurality of spaced slits inserted into the foam border, and a plurality of edge springs inserted into the plurality of spaced slits.

According to a third embodiment, a mattress is provided. The mattress comprises a plurality of inner coil springs fastened to the at least one wire. The mattress also comprises an edge support comprising a foam border extending along the outer perimeter of the mattress and around the inner coil springs, and further comprises a plurality of spaced slits inserted into the foam border, and a plurality of edge springs inserted into the plurality of spaced slits. The springs comprise two spaced horizontal wire members, and two inwardly extending substantially L-shaped legs joining the horizontal wire members, and further comprise circular coils substantially located at the midpoint of the L-shaped legs.

Additional features and advantages provided by the mattress construction and mattress of the present invention will be more fully understood in view of the drawings and the following detailed description.

BRIEF DESCRIPTION OF THE DRAWINGS

The following detailed description of specific embodiments of the present invention can be best understood when read in conjunction with the drawings enclosed herewith. The drawing sheets include.

DETAILED DESCRIPTION

Figure 1:
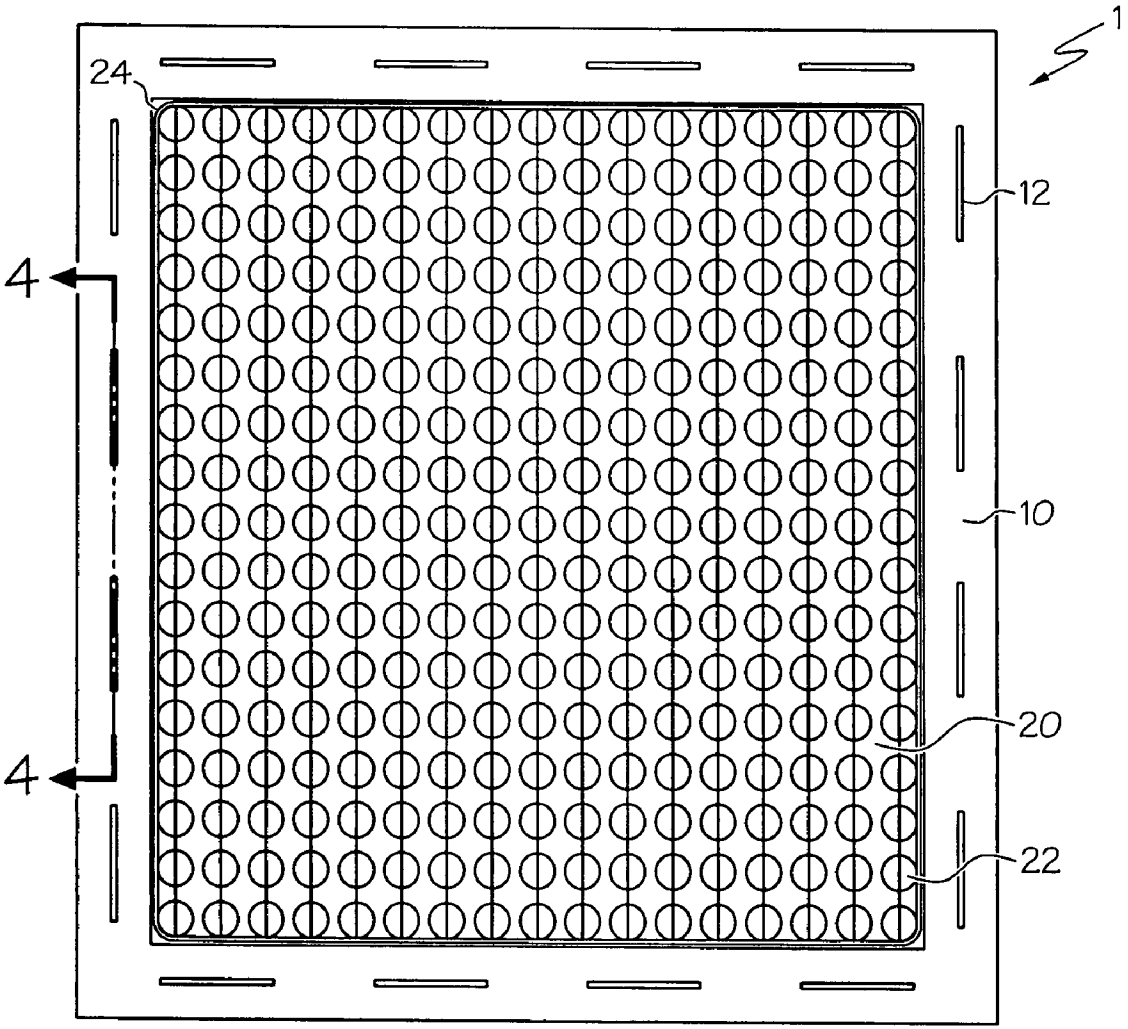
FIG. 1 is a top view of a mattress embodiment in accordance with the present invention.
Figure 2:
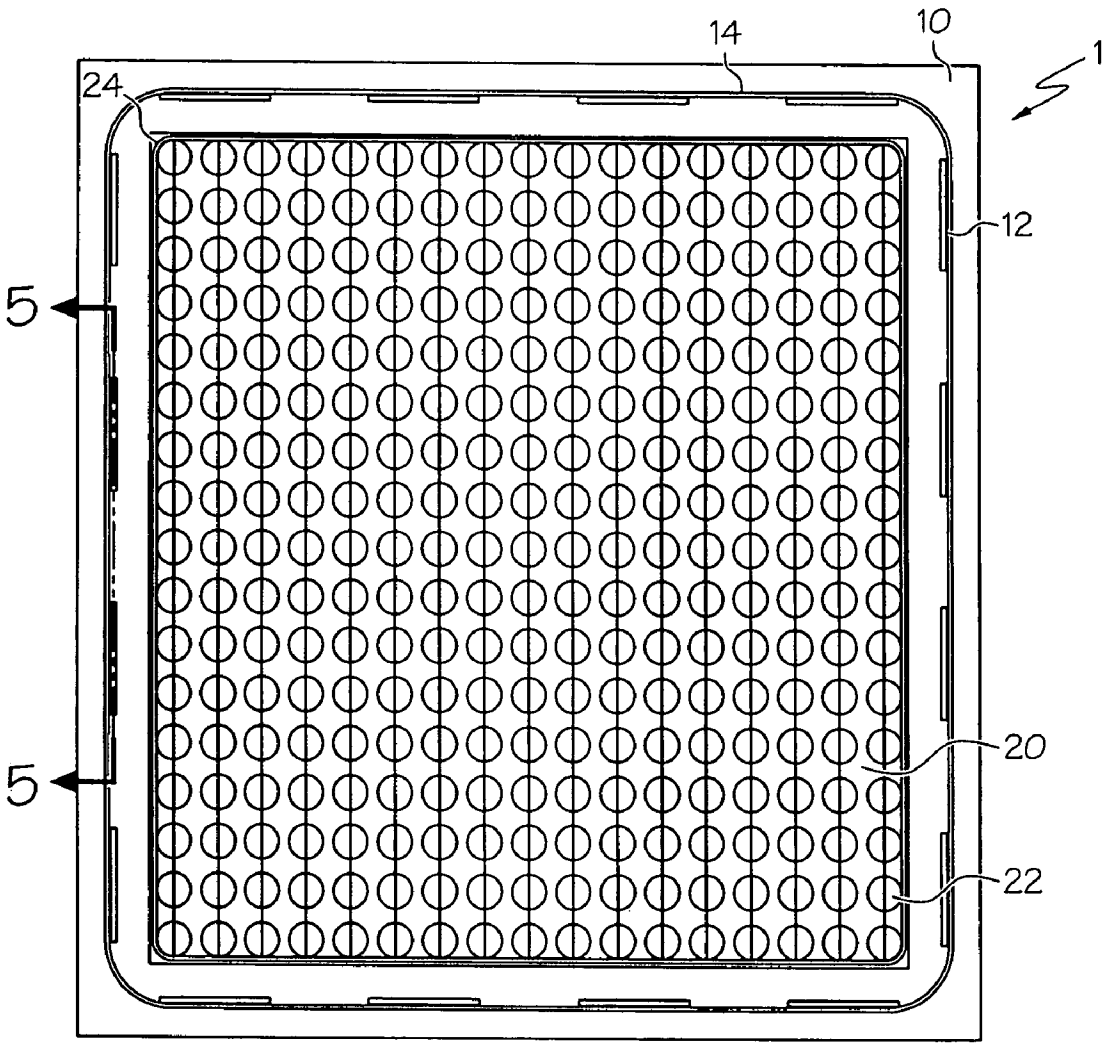
FIG. 2 is a top view of another mattress embodiment in accordance with the present invention.

Referring to FIGS. 1 and 2, two exemplary embodiments of a mattress 1 are provided. The mattress 1 comprises a plurality of inner coil springs 22. The inner coil springs 22 may be positioned in numerous configurations known to one of ordinary skill in the art. In one embodiment as shown in FIGS. 1 and 2, the inner coil springs may define an inner frame 20 having a generally rectangular shape with rounded corners. Further as shown in FIGS. 1 and 2, the inner coil springs 22 may comprise circular coils arranged in a web or interlaced configuration. The coils 22 may be connected to one another by any suitable means, for example, the coils may be "hog tied" to one another, stringed together, etc. In another embodiment, the mattress may comprise an inner border wire 24 extending along the outer perimeter of the inner coil springs. The springs 22 may couple with the inner border wire 24 to provide additional support to the mattress 1. The springs 22 may couple to the wire 24 by any suitable fastening means.

Figure 3:
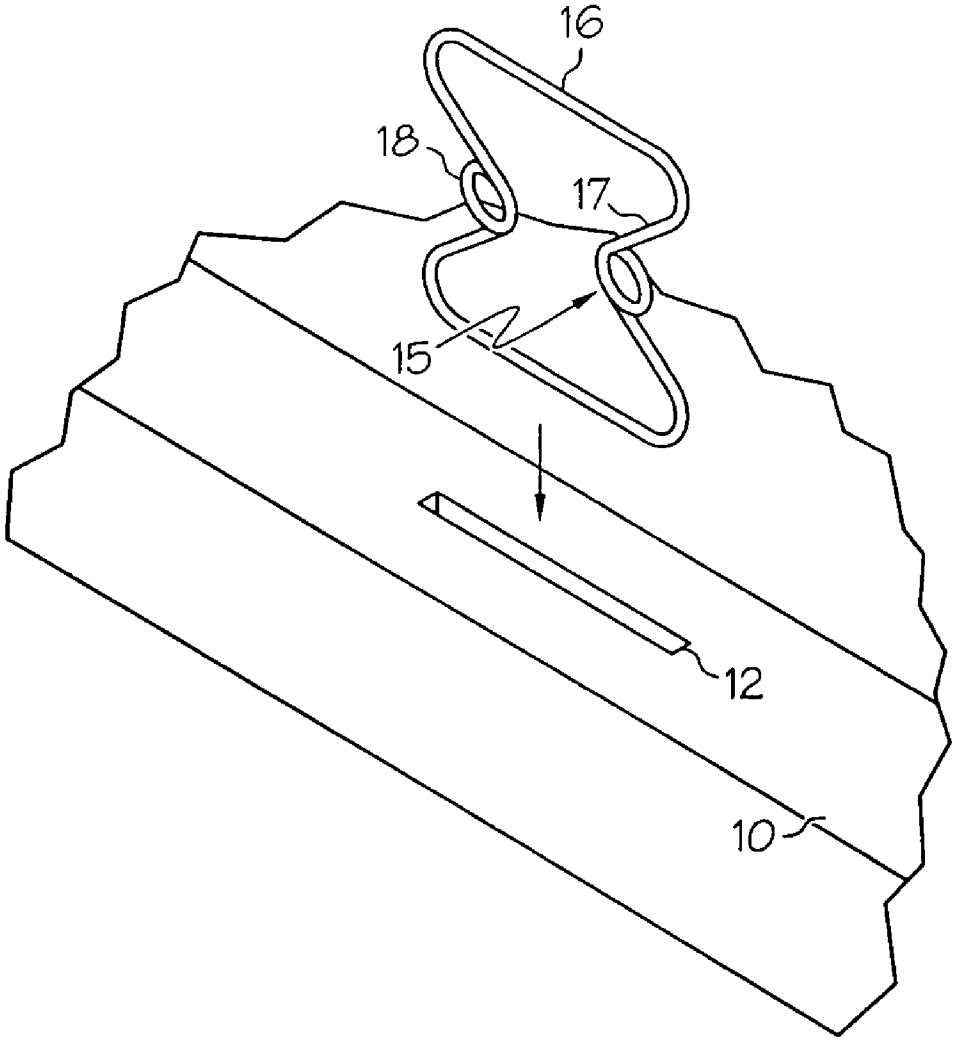
FIG. 3 is a side view of an edge support embodiment in accordance with one or more embodiments of the present invention.
Figure 4:
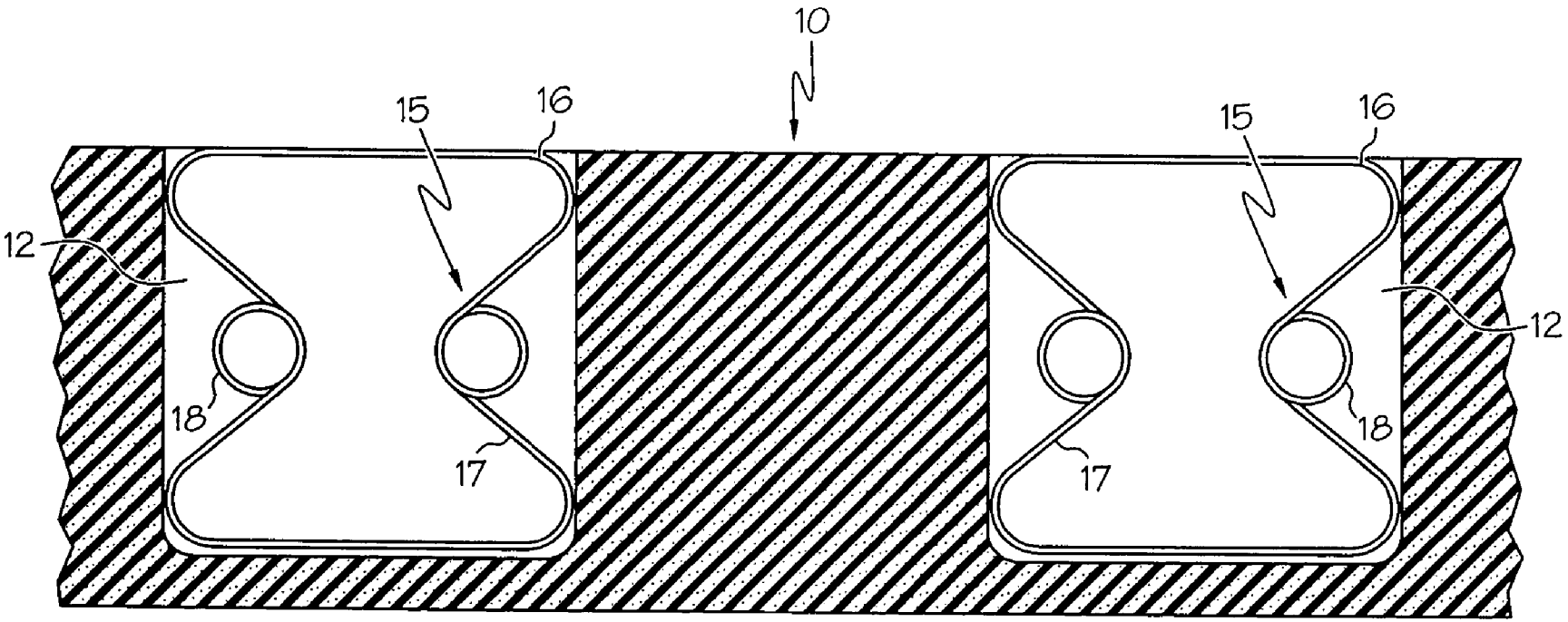
FIG. 4 is a cross-sectional view of an edge support embodiment in accordance with the present invention.
Figure 5:
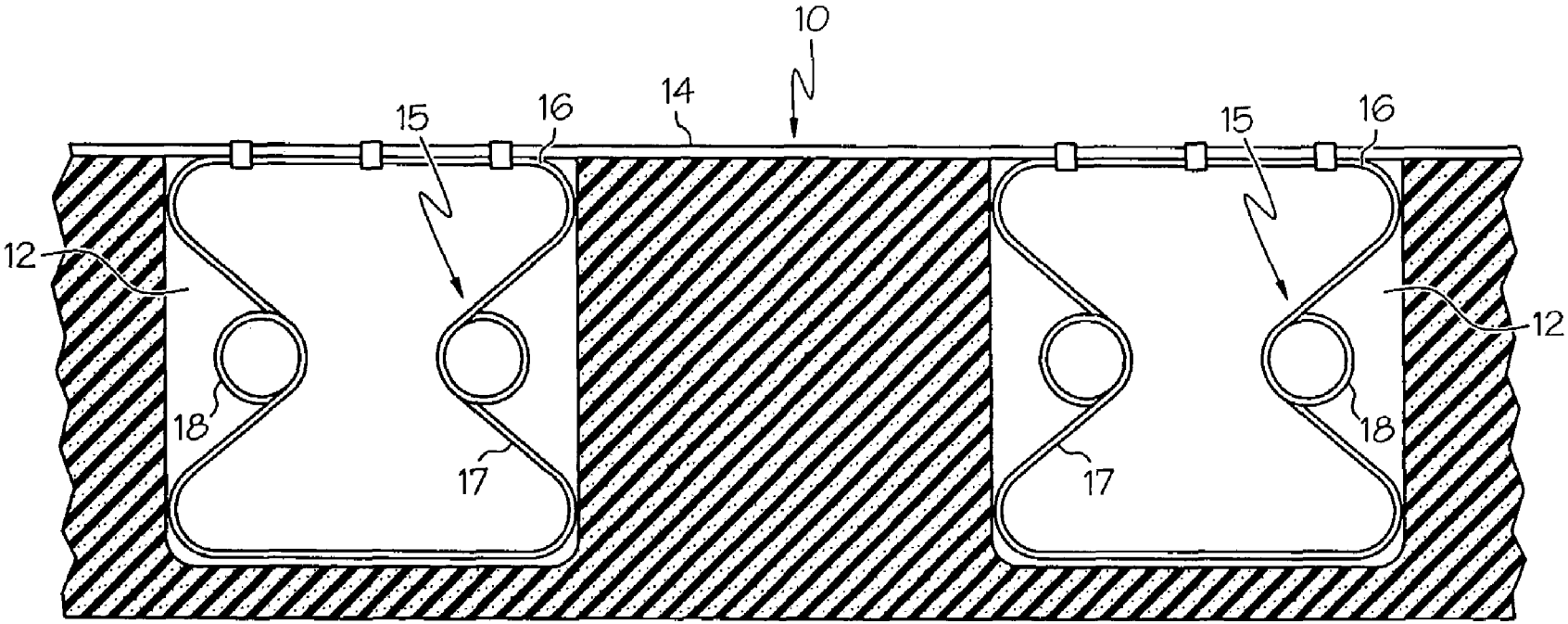
FIG. 5 is a cross-sectional view of an edge support embodiment in accordance with the present invention.
Figure 6:
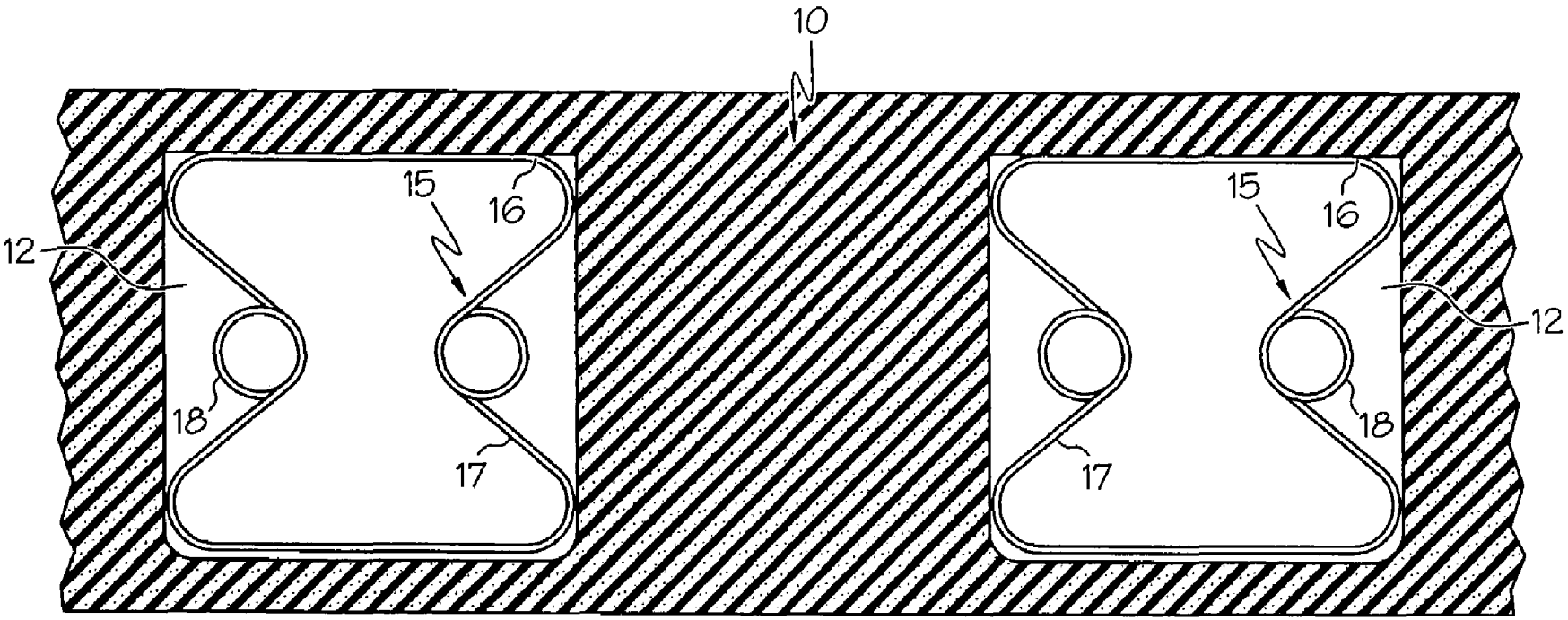
FIG. 6 is a cross-sectional view of an edge support embodiment in accordance with the present invention.

Referring generally to FIGS. 3-5, the mattress 1 also comprises an edge support extending along the outer perimeter of a mattress 1 and around the inner coil springs 22. The edge support comprises a foam border 10 having a plurality of spaced slits 12 inserted into the foam border 10, and a plurality of springs 15 inserted into the plurality of spaced slits 12. The foam border 10 may comprise any suitable polymeric foam material suitable to provide a cushioning effect in a mattress. The foam border 10 encases the spring 15 inside the slits 12 thereby limiting movement of the springs 15 inserted therein. By separating the slits 12 and springs 15 inserted therein and also limiting spring 15 movement, the foam material disposed between the slits 12 may reduce the noise generated by edge springs 15 contacting one another. As shown in FIGS. 4-6, the edge support springs 15 may be placed at various depths inside the foam.

In one embodiment as shown in FIG. 6, the springs may be inserted into the border such that substantially equal layers are foam are disposed above and below the edge springs 15.

The springs 15 may comprise various spring types, for example, coils, and may comprise springs of various dimensions. In one embodiment, the springs 15 comprise two spaced horizontal wire members 16, and two inwardly extending substantially L-shaped legs 17 joining the horizontal wire members 16. Furthermore, the spring 15 comprises circular coils 18 substantially located at the midpoint of the L-shaped legs 17. In a specific embodiment, the horizontal wire members 16 and the legs 17 are joined at a substantially curved junction point.

In one embodiment as shown in FIG. 4, the springs 15 are spaced a set distance apart; however, the spacing between slits 12 may vary as desired by the user. In addition, the dimensions of the slits 12 may vary depending on the size of the springs 15 inserted therein. Moreover, the foam border 10 may comprise as many slits 12 as desired. For instance, single beds may require less slits 12 and springs 15 than a king size bed. In one embodiment as shown in FIG. 4, the springs 15 may be separately inserted inside the slits, without a wire 14 used to interconnect the springs 15. By using separate non-connected springs, the edge springs 15 can be more easily replaced. For instance, if an edge spring 15 becomes defective, warped, or less resilient, the edge support can be repaired by simply sliding the defective spring 15 out of the slit 12, and inserting a replacement edge spring 15 in its place. In another embodiment as shown in FIG. 5, the mattress 1 may comprise at least one additional wire 14 extending along the foam border 10, wherein the edge springs 15 are operable to be coupled to the additional wire 14.

In another embodiment, the mattress 1 may comprise a cushioning pad surrounding the top and bottom portions of the inner rectangular frame 20, and in a further embodiment also surrounds the edge support. The mattress 1 also comprises an upholstery cover surrounding the cushioning pad and edge support 10 of the mattress 1. Although the edge support was defined in the context of mattresses, the edge support is also operable to be inserted into a box spring.

It is noted that terms like "specifically," "preferably," "commonly," and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention. It is also noted that terms like "substantially" and "about" are utilized herein to represent the inherent degree of uncertainty that may be attributed to any quantitative comparison, value, measurement, or other representation.

Having described the invention in detail and by reference to specific embodiments thereof, it will be apparent that modifications and variations are possible without departing from the scope of the invention defined in the appended claims. More specifically, although some aspects of the present invention are identified herein as preferred or particularly advantageous, it is contemplated that the present invention is not necessarily limited to these preferred aspects of the invention.

What is claimed is:

1. A box spring comprising:

a plurality of inner coil springs; and an edge support comprising, a foam border extending along the outer perimeter of the box spring and around the inner coil springs;

a plurality of spaced slits inserted into the foam border; and a plurality of edge springs not connected to the plurality of inner coil springs and inserted into the plurality of spaced slits, wherein the edge springs comprise two spaced horizontal wire members, two inwardly extending substantially L-shaped legs joining the horizontal wire members, and circular coils substantially located at the midpoint of the L-shaped legs.

2. A mattress comprising:

a plurality of inner coil springs; and an edge support comprising, a foam border extending along the outer perimeter of the mattress and around the inner coil springs;

a plurality of spaced slits inserted into the foam border; and a plurality of edge springs inserted into the plurality of spaced slits, wherein the edge springs comprise, two spaced horizontal wire members; and two inwardly extending substantially L-shaped legs joining the horizontal wire members, and comprising circular coils substantially located at the midpoint of the L-shaped legs.

3. A mattress according to claim 2 wherein the horizontal wire members and the legs are joined at a substantially curved junction point.

4. A mattress according to claim 2 further comprising at least one additional wire extending along the foam border.

5. A mattress according to claim 4 wherein the edge springs are operable to be coupled to the additional wire.

6. A mattress according to claim 2 wherein the plurality of slits are spaced a set distance apart.

7. A mattress according to claim 6 further comprising a cushioning pad surrounding at least the top and bottom portions of the plurality of inner coil springs.

8. A mattress according to claim 7 further comprising an upholstery cover surrounding the cushioning pad and edge support.

9. A mattress according to claim 2 wherein the inner springs comprise circular coils arranged in a web configuration.

10. A mattress according to claim 2 further comprising an inner border wire extending along the outer perimeter of the inner coil springs and configured to couple with the plurality of inner coil springs.

11. A mattress comprising:

a plurality of inner coil springs; and an edge support comprising, a foam border extending along the outer perimeter of the mattress and around the inner coil springs;

a plurality of spaced slits inserted into the foam border;

a plurality of edge springs not connected to the plurality of inner coil springs and inserted into the plurality of spaced slits; and at least one additional wire extending along the foam border.

12. A mattress according to claim 11 further comprising an inner border wire extending along the outer perimeter of the inner coil springs and configured to couple with the plurality of inner coil springs.

13. A mattress according to claim 11 wherein the edge springs comprise:

two spaced horizontal wire members; and two inwardly extending substantially L-shaped legs joining the horizontal wire members, and comprising circular coils substantially located at the midpoint of the L-shaped legs).

14. A mattress according to claim 13 wherein the horizontal wire members and the legs are joined at a substantially curved junction point.

15. A mattress according to claim 11 wherein the edge springs are operable to be coupled to the additional wire.

16. A mattress according to claim 11 wherein the plurality of slits are spaced a set distance apart.

17. A mattress according to claim 16 further comprising a cushioning pad surrounding at least the top and bottom portions of the plurality of inner coil springs.

18. A mattress according to claim 17 further comprising an upholstery cover surrounding the cushioning pad and edge support.

19. A mattress according to claim 11 wherein the inner springs comprise circular coils arranged in a web configuration.

* * * * *